US006598555B1

(12) United States Patent
Bruce

(10) Patent No.: US 6,598,555 B1
(45) Date of Patent: Jul. 29, 2003

(54) MARINE ANCHORS

(75) Inventor: Peter Bruce, Douglas (GB)

(73) Assignee: Brupat Limited, Douglas (GB)

( * ) Notice: Subject to any disclaimer, the term of this patent is extended or adjusted under 35 U.S.C. 154(b) by 0 days.

(21) Appl. No.: 09/806,508

(22) PCT Filed: Oct. 29, 1999

(86) PCT No.: PCT/GB99/03587

§ 371 (c)(1),
(2), (4) Date: Jul. 16, 2001

(87) PCT Pub. No.: WO00/26081

PCT Pub. Date: May 11, 2000

(30) Foreign Application Priority Data

Oct. 30, 1998 (GB) ..... 9825363
Nov. 4, 1998 (GB) ..... 9824006

(51) Int. Cl.[7] ..... B63B 21/24
(52) U.S. Cl. ..... 114/294; 114/295
(58) Field of Search ..... 114/293, 294, 114/295, 301, 304

(56) References Cited

U.S. PATENT DOCUMENTS 4,312,289 A * 1/1982 Conrad ..... 114/295
4,397,255 A * 8/1983 Taylor ..... 114/294
4,619,218 A * 10/1986 Kenny ..... 114/295
5,474,015 A * 12/1995 Bruce ..... 114/294

FOREIGN PATENT DOCUMENTS

EP 0161190 * 11/1995
GB 2286374 A * 8/1995
WO WO 98/32648 * 7/1998

* cited by examiner

*Primary Examiner*—Stephen Avila
(74) *Attorney, Agent, or Firm*—Jacobson Holman PLLC

(57) ABSTRACT

A marine anchoring arrangement is described wherein a marine anchor (1, 23) is drivingly embedded vertically into a mooring bed (10) by an elongate follower (13), especially by its own weight and that of the follower. The follower (13) has a bottom clevis part (103) adapted to hold detachably the anchor (1) via the anchor shank (2) by means of a fulcrum pin (17) whereby the anchor (1) may swing relative to the bottom part (103). For initial penetration, the anchor (1) is held in a position of minimum forward resistance, specifically with the forward direction F of the fluke (3) parallel to the follower axis (20) and this is achieved by a shear pin (109) between the anchor (1) and the bottom part (103). When the anchor (1) is embedded to a preferred depth (d) specifically at least twice the square root of the maximum projected fluke area (as viewed normal to direction F), the anchor (23) is moved to a position for anchor setting by pulling on an attached anchor cable (4/4A) so causing the shear pin (109) to fracture and the anchor (23) to rotate about the fulcrum axis until arrested by a stop (21) on the follower (13). The follower (13) can then be pulled clear and recovered. The above anchoring arrangement provides a considerably improved anchoring performance in comparison with existing direct embedment arrangements.

27 Claims, 10 Drawing Sheets

MARINE ANCHORS

The present invention relates to marine anchors and particularly to drag embedment and direct embedment anchors and their embedment means.

A marine anchor for embedment in a mooring bed is attached generally to an anchor line for connection to an object to be restrained by mooring in a body of water over the mooring bed. The anchor includes a load application point for the attachment of the anchor line thereto via anchor line attachment means (for example, a shackle) and a fluke member and includes a plane of symmetry containing a first direction in which the surface of the fluke member viewable from the load application point when the anchor is in operation has a maximum projected area and a second (forward) direction (F) in which said surface has a minimum projected area. Correspondingly, in these directions maximum and substantially minimum resistance to movement of the anchor in a mooring bed soil occurs. The anchor fluke tends to advance in the soil along the forward direction (F) of minimum resistance.

A drag embedment anchor is a marine anchor as described above wherein the anchor line attachment means load application point is located on the anchor such that pulling horizontally on the line with the anchor lying on the surface of a mooring bed causes the anchor to tilt into penetrative engagement therewith and then moves into the mooring bed soil with a substantial component of displacement occurring in the forward direction of minimum projected area of the fluke member surface. This causes the anchor to follow a curved burial trajectory as it embeds into the mooring bed soil. The location of the load application point thus allows the anchor line attachment means to function as the embedment means of the anchor.

A direct embedment anchor for example EP-A-0161190 is a marine anchor as described above which has an anchor line attachment means load application point located such that pulling on the attached anchor line causes the anchor to tend to move in the direction of maximum projected area of the fluke member when buried in the mooring bed soil. This causes the embedded anchor to follow a path that rises to and breaks out through the mooring bed surface and so prevents the anchor line and anchor line attachment means from functioning as the embedment means of the anchor. An alternative embedment means is therefore employed which comprises a pushing member, known as a follower, to engage with and push the anchor deep into the mooring bed soil substantially in the forward direction of minimum projected area of the fluke member.

Each anchor before-mentioned will hereinafter be referred to respectively as a marine anchor, a drag embedment anchor or a direct embedment anchor of the type described hereinbefore.

These anchors have disadvantages: the drag embedment anchor requires a sometimes unacceptable horizontal component of displacement to reach a desired embedment depth below the surface of a mooring bed and the direct embedment anchor suffers from a progressively reducing embedment depth when overloaded which ultimately results in catastrophic failure by breaking out of the mooring bed. Further, the direct embedment anchor requires to be pushed into the seabed by a long follower that is prone to being damaged and is difficult to handle when decking on an anchor-handling vessel.

The objectives of the present invention include inter alia mitigating these disadvantages. The present invention broadly provides anchoring apparatus comprising a marine anchor that follows a burial trajectory when dragged by an anchor line via an anchor line attachment means after being embedded to an initial buried position below a seabed surface and embedment means for establishing the initial buried position.

According to a first aspect of the present invention, a marine anchor as hereinbefore described and in operational configuration for operation below the surface of a mooring bed is a drag anchor characterised in that a straight line containing the load application point and the centroid of the fluke member surface viewable from the load application point forms a forward-opening angle (β) with the forward direction (F) in the range 68° to 85° for operation in soft cohesive soil and in the range 50° to 65° for operation in non-cohesive soil whereby a pulling force applied to the anchor by the anchor line at the anchor line attachment means load application point when the anchor fluke centroid is buried at least twice the square root of said maximum projected area below the mooring bed surface causes the anchor to tend to move in the soil of the mooring bed with a substantial component of displacement in the second forward direction.

Preferably said substantial component of displacement in said second forward direction exceeds 35 per cent of the actual displacement.

Further preferably said substantial component of displacement in said second forward direction exceeds 50 per cent of the actual displacement.

Preferably said centroid angle does not exceed 80° for operation in soft cohesive soil and does not exceed 60° for operation of non-cohesive soil.

Preferably said drag anchor is further characterised in that a plane orthogonal to the plane of symmetry of the anchor and containing a forward extremity of the fluke member and the loan application point forms a forward-opening angle (a) with the forward direction (F) which is not less than 95° for operation in soft cohesive soil and not less than 85° for operation in non-cohesive soil.

Preferably said point angle is not less than 100° for operation in soft cohesive soil and is not less than 90° for operation in non-cohesive soil.

Preferably the drag anchor according to the first aspect of the present invention comprises a fluke with a plate-like shank member rigidly attached thereto and lying parallel to said plane of symmetry.

Preferably said plate-like shank member includes an elongated slot for slidable movement therein of an anchor line attachment means, with a forward end of said slot serving as an anchor line attachment means load application point permitting deeper burial of the anchor by dragging and with a rear end located towards a rear edge of said fluke serving as a substitute anchor line attachment means load application point permitting easy rearwards recovery of the anchor in a direction substantially opposite to said forward direction.

Preferably a slide stop means is provided just aft of the forward end of said slot to restrain said attachment means at said load application point.

Preferably said slide stop means includes release means which cooperate with said anchor line attachment means whereby rotational displacement of said attachment means releases said slide stop means to permit said attachment means to slide in said slot towards the rear of said fluke.

Preferably said anchor line attachment means comprises an elongate shackle.

Further preferably said anchor line attachment means comprises an elongate member with an attachment point at one end serving for connection to an anchor line and with a clevis at another end carrying a pin member serving to engage slidably and rotatably in said slot in said shank member.

Preferably said shank member includes an arcuate surface centred on said load application point and said elongate member includes a stop slidably engageable on the arcuate surface whereby said pin member is held at the load application point in said slot until rotation of the elongate member about the load application point brings the direction of movement of the stop parallel to the slot whereupon the pin member is free to slide in the slot.

Preferably said anchor includes releasable rotation stop means which stops rotation of said elongate member at a predetermined position relative to said shank member when said pin member is at said load application point.

Preferably the length of said elongate member is such that, when the member is stopped from rotating by said releasable rotation stop means, a plane lying orthonogal to said plane of symmetry and containing a forward extremity of said fluke member and said attachment point on the elongate member forms a forward-opening angle with said second direction which does not exceed 95° and further preferably does not exceed 75°.

According to a second aspect of the present invention, a marine anchor and embedment means comprises one of a drag embedment anchor as hereinbefore described and said drag anchor, and an elongate follower member detachably attached thereto and adapted for pushing said anchor, substantially in said second forward direction of minimum projected area of the surface of said fluke member viewable from said anchor line attachment means load application point, until the anchor fluke centroid is at least twice the square root of said maximum projected area below the surface of a mooring bed whereby subsequent pulling on the anchor line after detachment of the follower member from the embedded anchor causes the anchor to tend to move in the soil of the mooring bed with a substantial component of displacement in said second direction.

According to a third aspect of the present invention, a marine anchor and embedment means comprises one of a drag embedment anchor and a direct embedment anchor and a drag anchor as hereinbefore described and an elongate follower member detachably attached thereto and adapted for pushing said anchor substantially in said second direction into a mooring bed characterised in that at least one of said anchor and said elongate follower is adapted to provide a reaction fulcrum about which the anchor may pivot.

Preferably said marine anchor is adapted for pivoting about said fulcrum when a pulling force is applied to the anchor by an attached anchor line.

Preferably said embedment means for directly embedding a marine anchor comprises an elongate follower member adapted to provide detachable attachment to a marine anchor and a reaction fulcrum about which the anchor may pivot when pushed into a mooring bed by said follower member.

According to a fourth aspect of the present invention, a marine anchor and embedment means comprises a marine anchor as hereinbefore described and an elongate follower member detachably attached thereto and adapted for pushing said anchor substantially in said second direction and further adapted to bend recoverably without suffering damage when subjected to transverse forces, for example, due to traversing a curved surface such as a stern roller of an anchor handling vessel.

According to a fifth aspect of the present invention, an embedment means for directly embedding a marine anchor comprises an elongate follower member adapted for detachable attachment to a marine anchor and further adapted to bend recoverably without suffering damage when subjected to transverse forces, for example, due to traversing a curved surface such as a stern roller of an anchor handling vessel.

Preferably said follower member includes a lower terminal segment attached to a lowering and recovering line and inlcudes a plurality of body segments supported by said lower terminal segment.

Preferably said body segments substantially encircle said lowering and recovering line.

Preferably said segments fit together by means of a convex protuberance on a segment registering with a corresponding concave recess on an adjacent segment.

Preferably said lowering and recovering line forms an axis passing through said body segments.

Preferably at least a portion of said line within said body segments comprises at least one of a rope and a chain.

Preferably at least a portion of said line within said body segments is formed of resiliently extensible material such as, for example, polyester rope.

Preferably when said line within said body segments is extended under tension when said follower is hanging vertically, said line is prevented from relaxing by a line stop means acting between an upper body segment and said line whereby said body segments are maintained in a state of axial compression which provides said elongate follower member with a degree of transverse stiffness to resist buckling when said follower is at least partly supported by contact with a sea bed surface.

Preferably said line stop means on said upper body segment is releasable whereby, when said follower is pulled up and bent over said curved surface, said line is released within the follower to allow relative axial movement between the line and the upper body segment to avoid excessive stretching of the line due to bending of the follower.

Preferably said line stop means is releaseable by means of movement of an actuator making contact with said curved surface.

Preferably said line stop means includes a tooth member located on one of said line and said upper body segment which engages in a recess in a recess member located on the other one of the line and the upper body segment.

According to a sixth aspect of the present invention, an embedment means for embedding said drag anchor comprises an anchor line attached thereto via an elongate rigid member anchor line attachment means, said elongate member having a first attachment point at one end serving for attachment to the anchor line and a second attachment point at another end for attachment to said anchor line attachment means load application point on the anchor, and releasable rotation stop means for holding the elongate member relative to the anchor such that a plane orthogonal to said plane of symmetry containing a forward extremity of said fluke member and said first attachment point forms a forward-opening angle with said second direction which does not exceed 750 to promote penetration of a mooring bed surface when the anchor is dragged thereover but which releases due to soil loading on said fluke as said fluke becomes buried in the mooring bed soil.

Preferably said elongate rigid member has a clevis at said second attachment point which carries a pin member serving to engage slidably and rotatably in said slot in said shank member of said drag anchor.

Embodiments of the present invention will now be described by way of example with reference to the accompanying drawings wherein.

Figure 1:
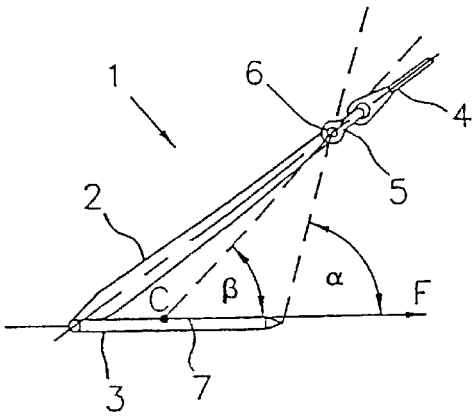
FIG. 1 shows a side elevation of a known drag embedment anchor.
Figure 2:
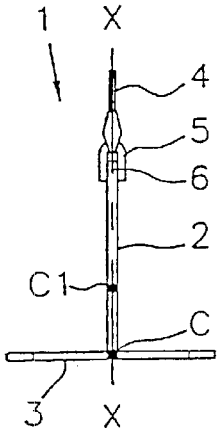
FIG. 2 shows a front elevation of the anchor of FIG. 1.
Figure 3:
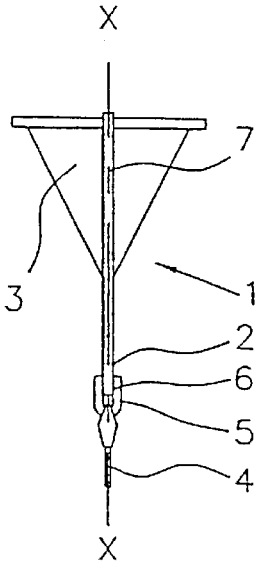
FIG. 3 shows a plan view of the anchor of FIG. 1.

A known drag embedment anchor 1 (FIGS. 1, 2, 3) for drag embedment in a mooring bed soil comprises a shank 2 connected at one end to a triangular plate-like or blade-like fluke 3 and at the other end to an anchor line 4 by means of a shackle 5 pivotably pinned in hole 6 in shank 2. Fluke 3 is of planar form and anchor 1 is symmetrical about a plane of symmetry X—X containing the centre of hole 6 in shank 2 and a centre-line 7 of fluke 3. Centre line 7 is parallel to a forward direction F of fluke 3 which points along fluke 3 away from the connection between shank 2 and fluke 3. A straight line in plane of symmetry X—X containing the centre of shackle hole 6 and a foremost point of fluke 3 forms a forward-opening point angle a with forward direction F. A straight line in plane of symmetry X—X containing the centre of shackle hole 6 and the centroid C of the upper surface of fluke 3 forms a forward-opening centroid angle $\beta$ with forward direction F of fluke 3.

Such a drag-embedment anchor is particularly disclosed in UK Patent 2,674,969 to R. S. Danforth wherein the limits of $\alpha$ and $\beta$ are given as 50° to 80° and 25° to 55° respectively. In UK Patent 553,235, Danforth discloses eta the importance of angles $\alpha$ and $\beta$ and states that a values exceeding 75° give rise to lack of dependable engagement of an anchor with a mooring bed surface and that $\beta$ values as high as 65° may be employed where an anchor is intended only for use on soft mud bottoms. These Danforth limits show that drag embedment anchor geometry hitherto has been constrained by the primary requirement to penetrate the surface of the seabed.

Drag embedment anchor 1 is laid out on a mooring bed surface 8 (FIG. 4) and pulled horizontally by anchor line 4. For a point angle a less than 75°, fluke 3 first penetrates the surface 8 and subsequently anchor fluke centroid C follows a curved trajectory 9 in the mooring bed soil 10 which eventually becomes horizontal at a limiting depth d below surface 8. The considerable horizontal displacement dd (drag distance) involved in achieving the desired penetration depth is often unacceptable when space available on the mooring bed is restricted.

Figure 5:
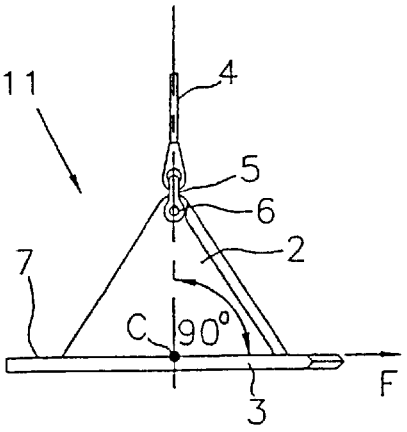
FIG. 5 shows a side elevation of a known direct embedment anchor.
Figure 6:
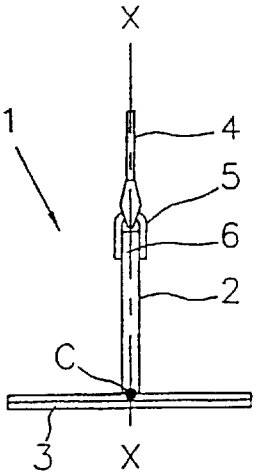
FIG. 6 shows a front elevation of the anchor of FIG. 5.
Figure 7:
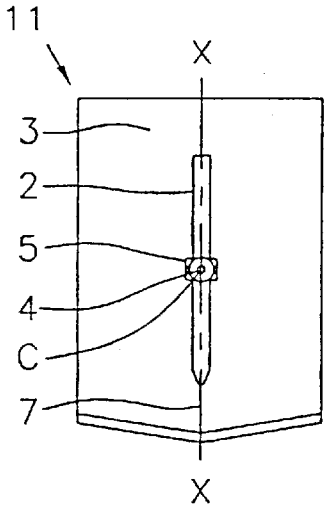
FIG. 7 shows a plan view of the anchor of FIG. 5.

A known direct embedment anchor 11 (FIGS. 5, 6, 7) for direct embedment in a mooring bed comprises a triangular plate shank 2 connected at one end to a substantially rectangular plate fluke 3 and at the other end to an anchor line 4 by means of a shackle 5 pivotably pinned in a hole 6 in shank 2. Fluke 3 is of planar form and anchor 11 is symmetrical about a plane of symmetry X—X containing shackle hole 6 in plate shank 2 and a centre line 7 of fluke 3. A forward direction F is parallel to centre-line 7 of fluke 3. A straight line in plane of symmetry X—X containing the centre of shackle hole 6 and the centroid C of the upper surface of fluke 3 forms an angle of 90° with centreline 7.

Figure 8:
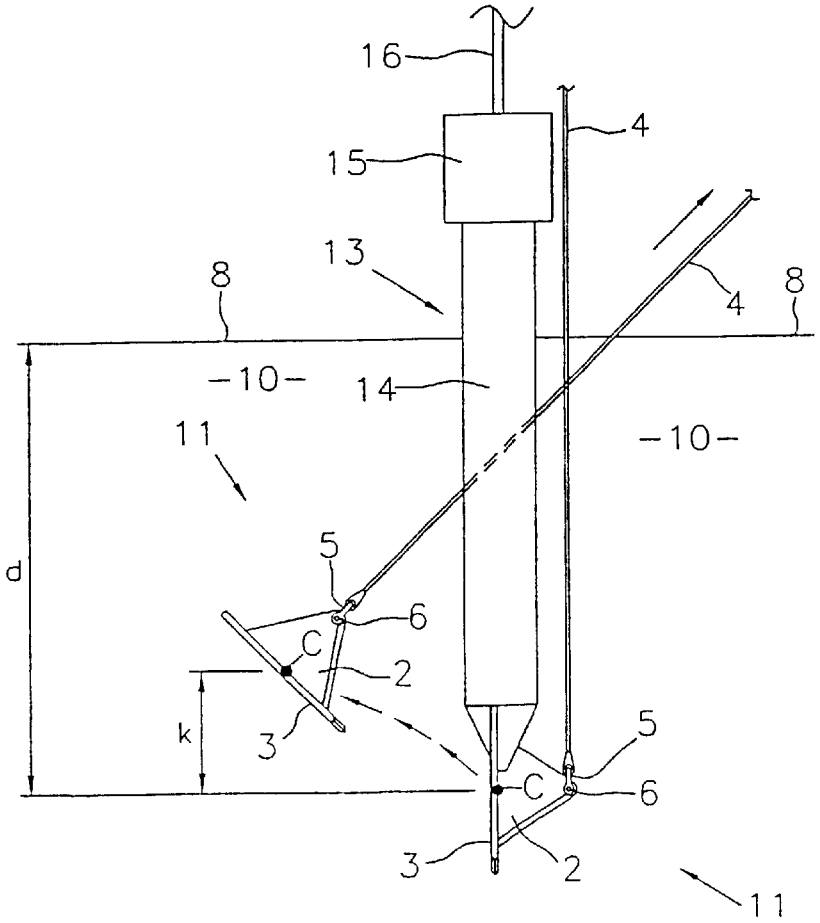
FIG. 8 shows installation of the anchor of FIG. 5 in a mooring bed.

Direct embedment anchor 11 is driven vertically (FIG. 8) into a mooring bed 10 by means of a rigid elongate follower member 13 detachably attached thereto. Follower member 13 comprises a pile 14 driven by a pile-driving hammer 15 attached thereto and suspended from a line 16. Driving is completed when centre of area C of fluke 3 is at a desired depth d below the mooring bed surface 8. The pile 14 is then disengaged from anchor 11 by pulling up on line 16 and an inclined pulling force applied via anchor line 4 causes anchor 11 to rotate and simultaneously displace upwards through distance k until the line of action of force in anchor line 4 passes through centroid C of fluke 3. The direct embedment anchor 11 is now orientated such as to provide maximum resistance to movement induced by tension in anchor line 4 at the d minus k burial depth actually achieved. However, if the anchor line 4 is loaded higher than this maximum resistance, the direct embedment anchor will fail catastrophically by moving in the direction of the anchor line 4 until it rises up to and breaks out of the sea-bed surface 8. For this reason, an installation factor of safety of 2 is generally required for such anchors.

In a first embodiment of the present invention, a drag embedment anchor 1 as hereinbefore described, with angle β (FIG. 1) at a preferred high value, is detachably and pivotably attached at pivot 17 (FIG. 9) on shank 2 to a cooperating clevis 18 in a lower extremity 19 of a heavy elongate follower 13 suspended by a lowering and retrieving line 16. Centre line 7 of fluke 3 is arranged initially parallel to a longitudinal axis 20 of follower 13 such that fluke 3 presents minimum projected area in the direction of axis 20 and the centre of area C1 (FIG. 2) of the sum of the minimum projected areas of anchor 1 and shackle 5 lies in line with axis 20. Pulling on anchor line 4 parallel to axis 20 rotates anchor 1 about pivot 17 until arrested by shank 2 contacting a stop 21 in clevis 18 whereupon a desired orientation of anchor 1 is established. A small shear pin 22 (FIG. 10) passing through clevis 18 and shank 2 serves to hold anchor 1 in clevis 18 with centre line 7 of fluke 3 parallel to axis 20 prior to said rotation.

Figure 4:
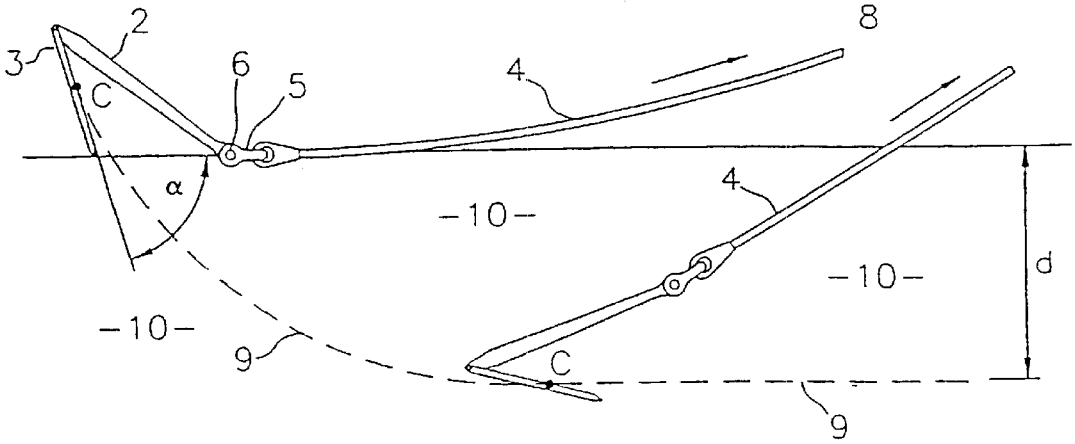
FIG. 4 shows installation of the anchor of FIG. 1 in a mooring bed.

Embedment of anchor 1 (FIG. 9) is achieved simply by lowering anchor 1 attached to follower 13 onto the surface 8 of mooring bed 10 and continuing to pay out line 16 with anchor line 4 kept slack. Anchor 1 is forced into mooring bed 10 by the weight of heavy follower 13 until the centroid C of fluke 3 is at a desired depth d below mooring bed surface 8 that exceeds twice the square root of the maximum projected area of fluke 3. This is achieved by appropriately selecting the mass of follower 13. Line 16 is then left slack and anchor line 4 is heaved up. With follower 13 still in place to provide a reaction element, the heaving tension in line 4 causes shear pin 22 (FIG. 10) to part and anchor 1 to rotate in the mooring bed soil 10 about pivot 17 until shank 2 is arrested by stop 21 in clevis 18. The centroid C of fluke 3 thus moves slightly deeper than depth d below surface 8 and the disadvantageous loss of depth of burial k shown in FIG. 4 is eliminated. Follower 13 is then disengaged from anchor 1 by heaving up on line 16 and an inclined force is applied to anchor line 4 causing it to cut into soil to move anchor 1 substantially in forward direction F along a downwards inclined trajectory 9 wherein further embedment of anchor 1 allows progressively higher loads in anchor line 4 to be sustained. Although directly embedded without undesirable horizontal movement, anchor 1 does not fail catastrophically, when overloaded, by moving in the direction of anchor line 4 to pull out at surface 8 but instead moves horizontally at constant load or dives deeper with increasing load in a safe manner. Thus, an installation safety factor of 1.5 that is accepted for drag embedment anchors can be adopted instead of a safety factor of 2 that is usually mandatory for direct embedment anchors known to fail catastrophically. This allows smaller anchors to be utilised in a given mooring system at lower cost.

Figure 9:
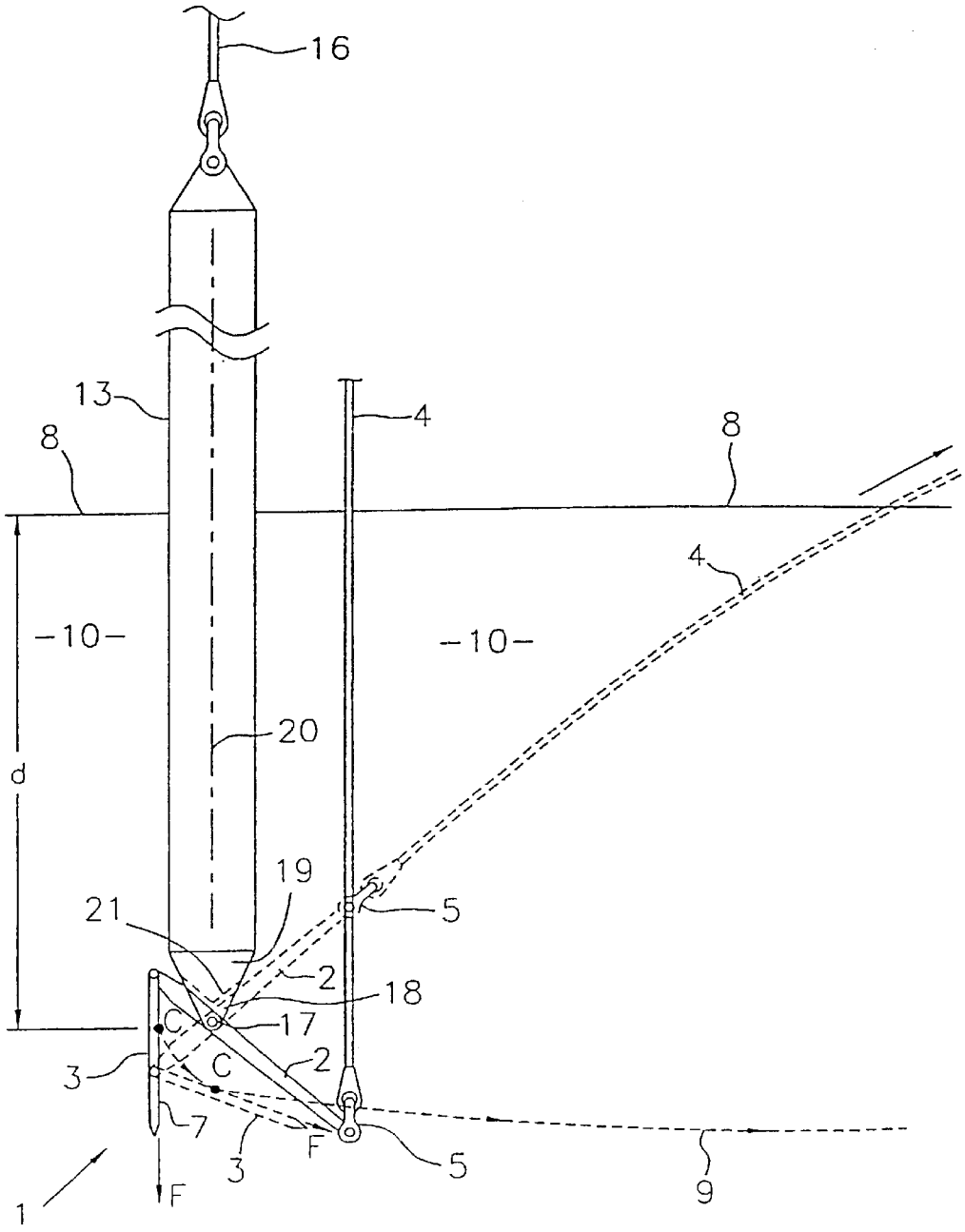
FIG. 9 shows a side elevation view of the drag embedment anchor of FIG. 1 and a follower member according to the present invention installed in a mooring bed.
Figure 10:
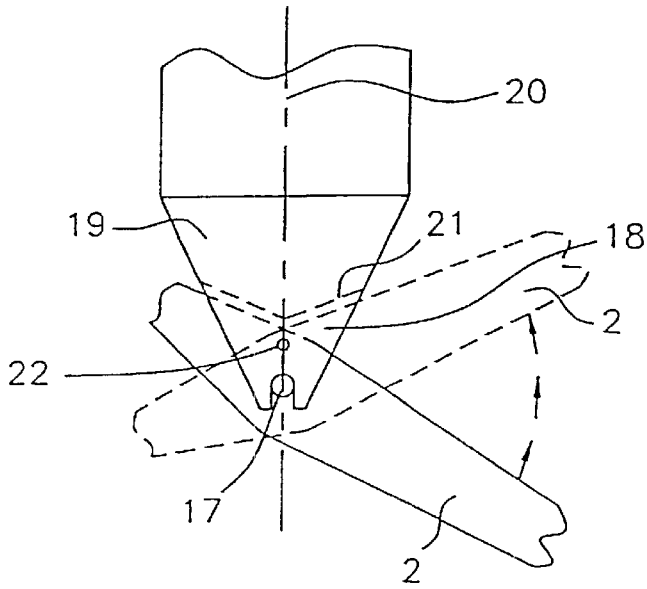
FIG. 10 shows an enlarged detail of the anchor and follower of FIG. 9.

However, the drag embedment anchor 1 (FIG. 9) has values of angles α and β (FIG. 1) which are within the Danforth limits before-mentioned and so retains the capability of penetrating the sea-bed surface when dragged horizontally thereover. In consequence, the shank is longer than is necessary for progressive burying once the anchor is below the seabed surface. This excess length produces undesirably high penetration resistance when it is embedded vertically into the seabed and thus requires an unduly heavy follower 13 (FIG. 9).

A drag anchor according to the present invention, in contrast, has values of angles α and β which exceed the Danforth limits and so does not have the capability of penetrating the sea-bed surface when dragged horizontally thereover although it retains the capability of progressively burying when dragged horizontally from a position already below the sea-bed surface. The presently described drag anchor therefore requires only a short compact shank member and so provides minimal resistance to being pushed vertically into the seabed by a follower. Further, the high values of angles α and β allow the drag anchor advantageously to follow a trajectory 9 which is much steeper than is possible for the drag embedment anchor constrained by the Danforth limits.

Thus, both a drag embedment anchor and a drag anchor will bury when dragged in a mooring bed from a starting position at some depth below the surface of the mooring bed. The drag embedment anchor is constrained by the inclusion of structural adaptation to enable self-penetration through the surface of a mooring bed. The drag anchor is not subject to such a constraint and, indeed, the drag anchor may be incapable of self-penetration through a mooring bed surface. A marine anchor comprising a drag anchor free of said constraint is disclosed in the present invention that permits hitherto unachievable capabilities to be realised.

According to a second embodiment of the present invention, a drag anchor 23 (FIGS. 11, 12, 13) in a configuration permitting operation when installed below the surface 8 of a mooring bed 10 by a follower 13 (FIG. 22) comprises a quadrilateral steel plate shank 2 lying in a plane of symmetry X—X of anchor 23 and welded at right angels to an upper planar surface 24 of a square steel plate fluke 3 of length L. The average thickness of shank 2 and of fluke 3 does not exceed 0.04 times (and preferably does not exceed 0.03 times) the square root of the maximum projected area of fluke 3. Centre-line 7 of surface 24 lies in plane of symmetry X—X at right angles to an edge 25 of fluke 3 which is sharpened by bevelling to reduce soil penetration resistance.

A load application and attachment point 26 for a shackle 5 connecting an anchor line 4 to shank 2 is located at an extremity 27 of shank 2 remote from fluke 3. The direction from the centroid C of surface 24 along centre-line 7 to sharpened edge 25 defines a forward direction F. A plane containing shackle attachment point 26 and sharpened edge 25 forms a line intercept with plane of symmetry X—X that defines a forward-opening angle α in plane X—X with respect to forward direction F. A straight line containing the centroid C and shackle attachment point 26 forms a forward-opening angle β with respect to forward direction F. Angle α is not less than 95° for operation of anchor 23 in soft cohesive soil (clay) and not less than 85° for operation in non-cohesive soil (sand) with preference for (x being not less than 100° and 90° for soft clay and sand respectively. Angle β may be as close to 90° as possible without preventing anchor 23 from moving in the soil of mooring bed 10 with a substantial component 9B (FIG. 24) of displacement of centroid C occurring in direction F. Preferably, said substantial component may be regarded as being not less than 35 per cent of the displacement 9A in the actual direction of movement with 50 per cent further preferred. However, in practice, angle β (FIG. 11) does not exceed 85° for operation of anchor 23 in soft clay and does not exceed 70° for operation in sand. Further, angle β is in the range 68° to 85° for operation in soft clay and 50° to 65° for operation in sand. It is preferred that angle β does not exceed 80° for operation in soft clay and does not exceed 60° for operation in sand.

Figure 11:
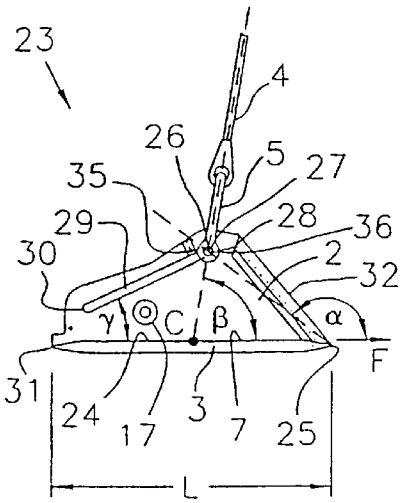
FIG. 11 shows a side elevation of a drag anchor according to the present invention.
Figure 12:
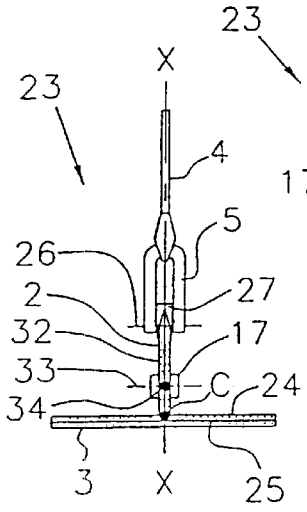
FIG. 12 shows a front elevation of the anchor of FIG. 11.
Figure 13:
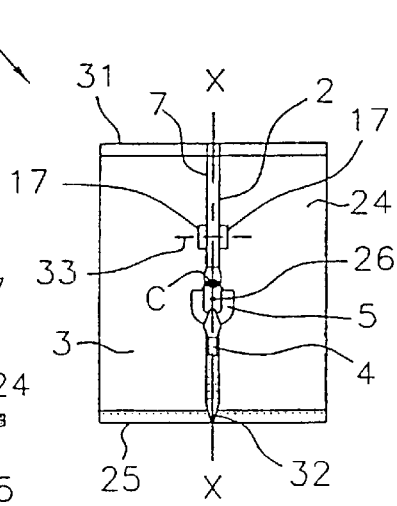
FIG. 13 shows a plan view of the anchor of FIG. 11.
Figure 14:
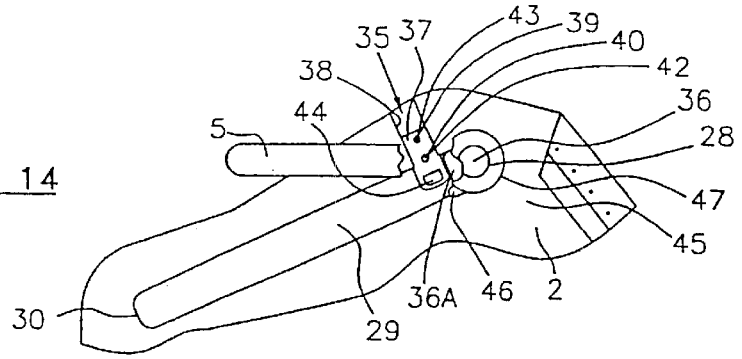
FIG. 14 shows a shackle stop detail of FIG. 11 with the shackle stopped.
Figure 15:
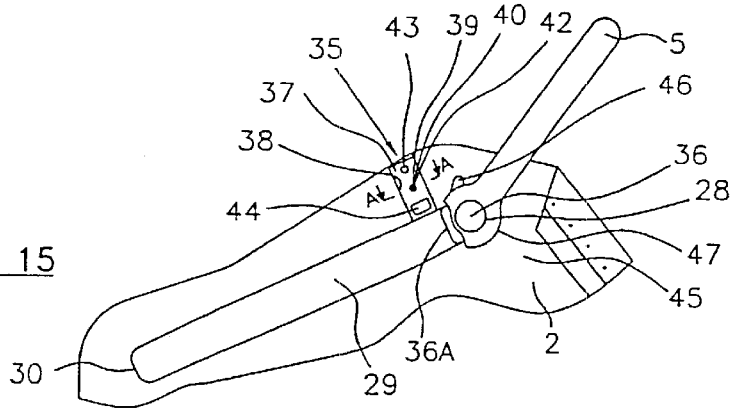
FIG. 15 shows the detail of FIG. 14 with the shackle stop released.
Figure 16:
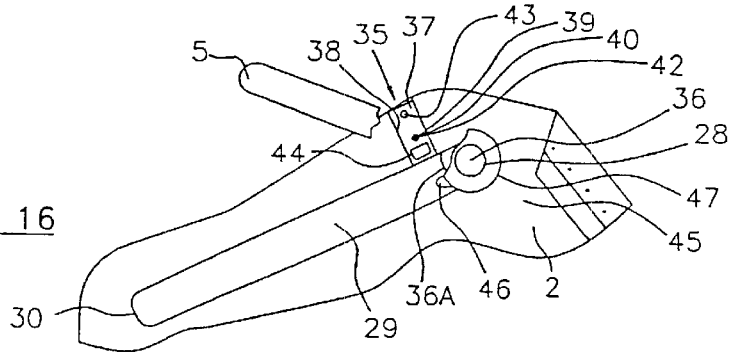
FIG. 16 shows the detail of FIG. 15 with the shackle in a position to move past the release stop.
Figure 17:
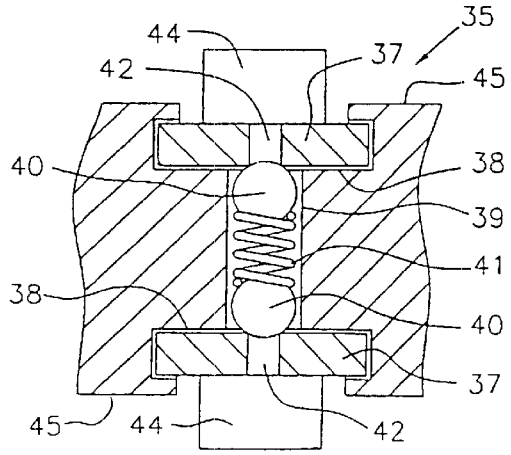
FIG. 17 shows a section A—A through the shackle stop in FIG. 15.
Figures 22, 23, 24:
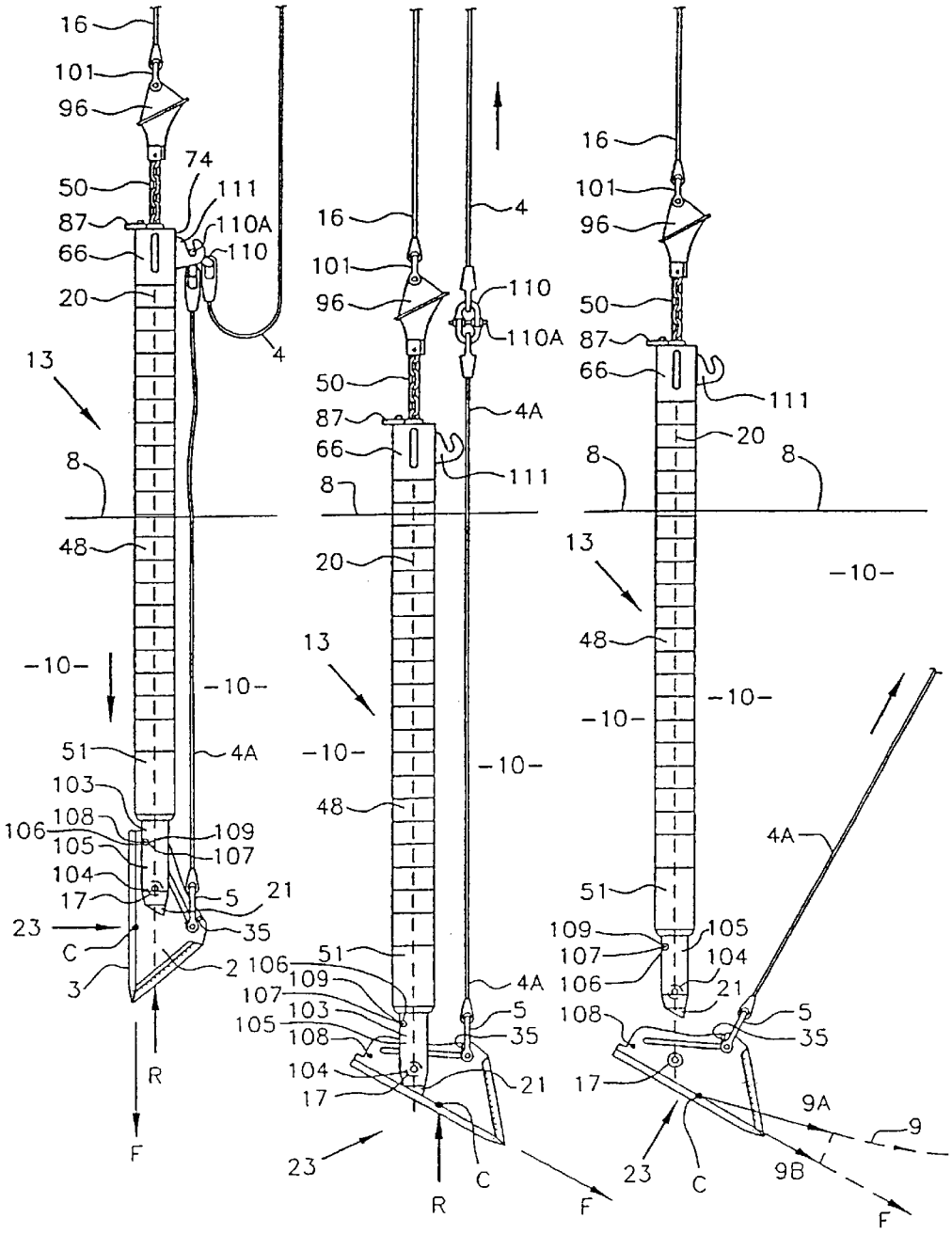
FIG. 22 shows the anchor of FIG. 11 and a follower member according to the present invention installed in a mooring bed.
FIG. 23 shows rotation of the anchor of FIG. 11 by reacting against the follower member of FIG. 22.
FIG. 24 shows anchor line tensioning of the rotated anchor and recovery of the follower member of FIG. 23.
Figure 25:
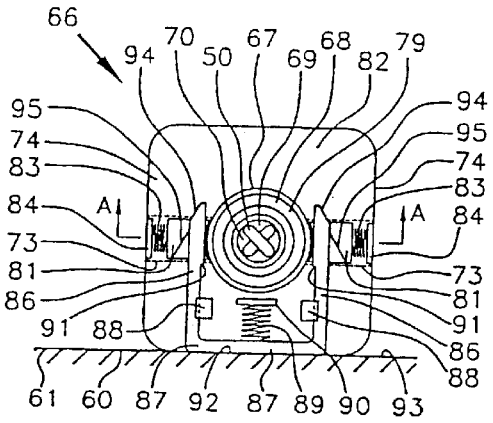
FIG. 25 shows a plan view of the top terminal (control) segment of the follower member of FIG. 23 with a disengaged chain locking mechanism.

Shackle attachment point 26 (FIG. 11) is formed by a forward extremity 28 of an elongate straight slot 29 in shank 2. A rearward extremity 30 of slot 29 is located adjacent to a rear edge 31 of fluke 3 and slot 29 forms a forward-opening angle γ of up to 30° with centre-line 7, with 10° preferred. A forward edge 32 of shank 2 is sharpened by bevelling to reduce soil penetration resistance as for edge 25 of fluke 3. The separation of shackle attachment point 26 from centroid C is preferred to be in the range 0.15L to 0.6L. A cylindrical steel pin 17 (FIGS. 11–13) is mounted transversely through shank plate 2 to act as a pivot and bearing pin for mating with an installation follower 13 (FIGS. 22, 23, 24). Axis 33 of pine 17 is spaced from surface 24 such that the line of axis 20 of follower 13 passes through the combined centre of area 34 (FIG. 12) of anchor 23 and shackle 5 (when anchor line 4 is pulled back to lie parallel to direction F) as viewed in opposition to direction F (FIGS. 11, 12, 22). This ensures that the resultant soil penetration resistance force R (FIG. 22) on anchor 23 is co-linear with follower axis 20 during initial driven embedment of drag anchor 23. A releasable shackle stop 35 (FIGS. 11, 14, 15, 16, 17) in shank 2 holds pin 36 of shackle 5 in extremity 28 of slot 29. Stop 35 includes two rectangular plates 37 slidably located in undercut recesses 38 one at each side of shank 2 aft of extremity 28 of slot 29 and on a side of slot 29 remote from fluke 3. Plates 37 initially occupy a position partly in recesses 38 and partly in slot 29 whereby pin 36 of shackle 5 is prevented from sliding away from extremity 28 of slot 29. A drilled hole 39 (FIG. 17) in shank 2 between recesses 38 contains two steel balls 40 of a diameter slightly less than the diameter of hole 39. Steel balls 40 are held apart by a compression spring 41. Plate 37 has a central hole 42 and an offset hole 43 drilled therein which engages with a ball 40 to determine the slidable position of plate 37 in recess 38. Plate 37 also has an upstanding block 44 attached at an end remote from offset hole 43 that protrudes beyond side surface 45 of shank 2 (FIG. 17). A cam 46 (FIG. 14) protruding inside each eye 47 of shackle 5 is located such that sliding contact between cam 46 and block 44 occurs in the course of shackle 5 being rotated from parallel with to perpendicular to surface 24 of fluke 3. Cams 46 thereby push on blocks 44 to cause plates 37 to depress balls 40 out of engagement with holes 43 and then slide until balls 40 engage in holes 42 whereupon plates 37 are held wholly clear of slot 29 (FIG. 15). A shouldered non-rotatable sleeve 36A slidable in slot 29, may be fitted on pin 36 (FIG. 15) to prevent plates 37 being prematurely moved by friction between pin 36 and plates 37 as shackle 5 rotates to bring cams 46 into contact with blocks 44.

Subsequent pulling aft-wards of anchor line 4 rotates shackle 5 backwards until cams 46 clear blocks 44 thus allowing sleeve 36A and pin 36 to slide along slot 29 to relocate at extremity 30 (FIG. 11) whereby low load retrieval of anchor 23 by means of the anchor line 4 is possible. Resetting of stop 35 is achieved later simply by use of a hammer and drift on each of plates 37 in turn to re-engage balls 40 in offset holes 43 and so cause plates 37 to protrude once again into slot 29 to stop shackle 5 from sliding away from extremity 28 of slot 29.

According to a third embodiment of the present invention, a follower member (FIGS. 18–25) for directly embedding a marine anchor below the surface 8 of a mooring bed 10 comprises an elongate member 13 including a plurality of body segments 48. Segments 48 (FIGS. 19–21) are of width W and of square cross-section to provide stability on deck. Segments 48 are axially symmetrical about an axis 20 with an axial passageway 49 provided there through to accommodate a chain 50 attached to a bottom terminal segment 51 of follower 13. Passageway 49 is cruciform in cross-section to constrain chain 50 rotationally relative to segments 48.

Figure 19:
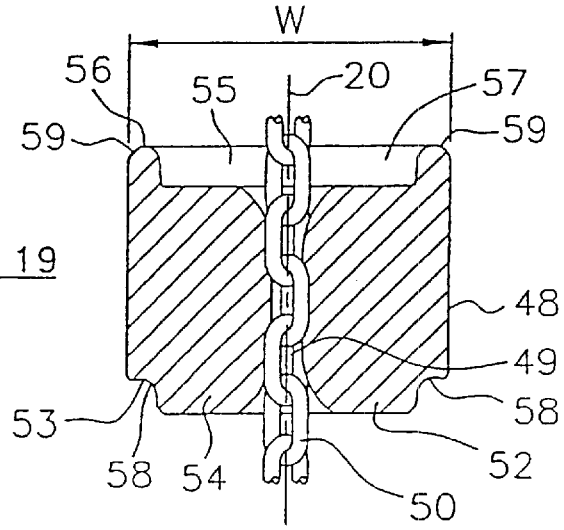
FIG. 19 shows a sectional side elevation of a segment of the follower member of FIG. 18.
Figure 20:
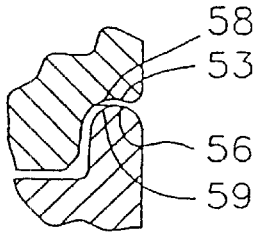
FIG. 20 shows a part section of a fit between adjacent segments of FIG. 18.
Figure 21:
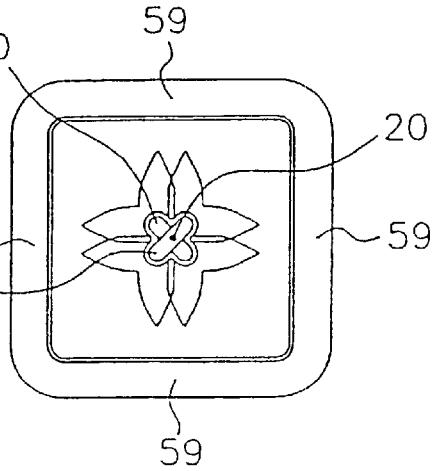
FIG. 21 shows a plan view of the segment of FIG. 18.

Segments 48 (FIG. 19) are each provided with a truncated conical protrusion 52 projecting from a peripheral surface 53 at an end 54 of segment 48 and a corresponding truncated conical recess 55 indented in a peripheral surface 56 at an opposite end 57 such that a protrusion 52 on one segment 48 fits closely into a recess 55 in an adjacent segment 48. Mating cylindrical surfaces 58 and 59 respectively permit adjacent segments 48 to rotate whilst maintaining peripheral contact with each other (FIGS. 19–21). The axial passageway 49 in each segment 48 is flared at each end to minimise axial bending of chain 50 due to rotation between adjacent segments 48 as follower 13 passes over a cylindrical stern roller 60 onto deck 61 of anchor handling vessel 62 floating on sea surface 63. Chain 50 is secured to bottom terminal segment 51 (FIG. 30) by means of pin 64 passing through end link 65 of chain 50 which is threaded through each of segments 48 (FIGS. 18, 22–24) and through an upper body segment 66 which functions as a control segment for holding and releasing tension in chain 50.

Figure 26:
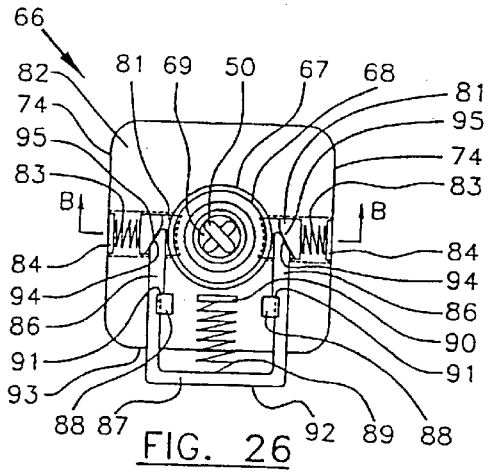
FIG. 26 shows the control segment of FIG. 25 with the chain locking mechanism engaged.

Control segment 66 (FIGS. 25–28) has an axial borehole 67 containing an elongate cylindrical pig 68 that has an axial borehole 69 for accommodating chain 50 passing there through. Split cylindrical collar 70 is rigidly fixed onto three links (FIGS. 27–28) of chain 50 to fit closely inside the length of borehole 69 and is rotationally and axially restrained therein by shear pin 71 passing through collar 70 and wall 72 of pig 68. Pin 71 is machined to shear at a load that is less than the breaking tension of chain 50 to provide overload protection for chain 50. Control segment 66 has slots 73 in opposed side faces 74 which penetrate through to borehole 67. Pig 68 has opposed keying blocks 75 bolted thereto that engage in and are slidable in slots 73 and serve to restrain pig 68 rotationally with respect to control segment 66. Internally threaded sleeve 76 is engaged on external thread 77 on wall 72 of pig 68 so as to be axially adjustable and lockable thereon by threaded locking ring 78 which has a bevelled surface 79 remote from sleeve 76. Sleeve 76 has a peripheral groove 80 (FIGS. 27–28) which receives a pair of opposed latches 81 slidably mounted on upper surface 82 of control segment 66 and driven to protrude into borehole 67 by compression springs 83 reacting against lugs 84 upstanding from surface 82. Each latch 81 has a lower inclined face 85 (FIGS. 27–28) for contacting bevelled surface 79 on locking ring 78 and displacing latch 81 against spring 83 to allow passage of locking ring 78 and subsequent engagement of latch 81 in groove 80 of sleeve 76. The positions of latches 81 are controlled by two arms 86 of a U-shaped yoke 87 (FIGS. 25–26) that is slidably restrained on surface 82 by stop lugs 88 upstanding there from. Compression spring 89 reacting against lug 90 upstanding from surface 82 forces yoke 87 away from lug 90 until stops 91 on arms 86 engage on stop lugs 88 whereby external edge 92 of yoke 87 protrudes beyond edge 93 of surface 82 (FIG. 26) unless held in alignment with edge 93 by contact with stern roller 60 or deck 61 of anchor handling vessel 62 (FIGS. 18, 26).

Figure 18:
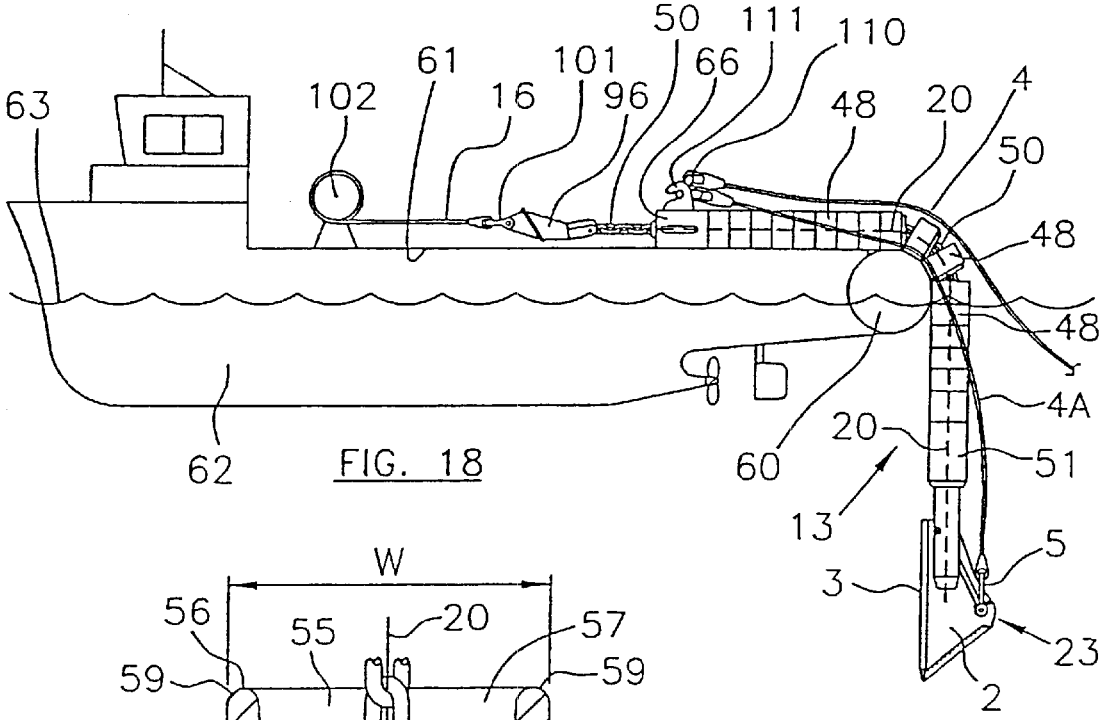
FIG. 18 shows the anchor of FIG. 11 and a follower member according to the present invention traversing a stern roller of an anchor handling vessel.
Figure 28:
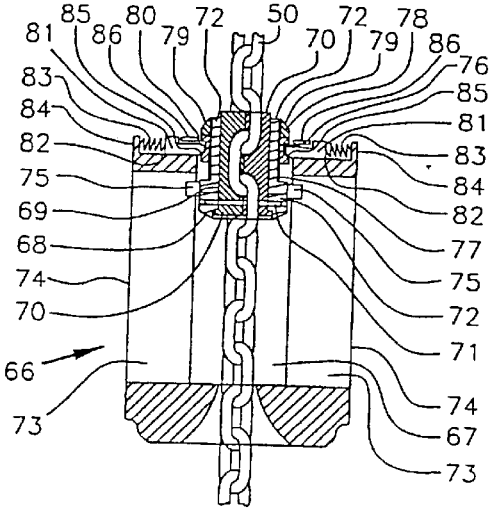
FIG. 28 shows a sectional side elevation of the control segment as shown in FIG. 26.

Each arm 86 of yoke 87 has an inclined face 94 (FIGS. 25–26) which pushes on a mating inclined face 95 on each latch 81 when edge 92 of yoke 87 is forced into alignment with edge 93 of control segment 66 by contact with roller 60 or deck 61 (FIG. 18). This forces latch 81 to compress spring 83 and move out of engagement with groove 80 in sleeve 76 (FIG. 28). Pig 68 is thus freed to be slidable through a distance W/4 along borehole 67 to prevent undesirable extra tension being included in chain 50 due to follower 13 (FIG. 18) bending through 90° on traversing stern roller 60.

The axial position of sleeve 76 on pig 68 is adjustable and lockable by ring 78 such that when follower 13 is hanging wholly below roller 60, the buoyant weight of follower 13 stretches chain 50 just sufficiently to bring latches 81 into engagement with groove 80 on pig 68. This automatically prevents the stretch in chain 50 from relaxing as the weight of follower 13 becomes progressively supported during penetration into a seabed soil. A progressively increasing clamping force between the segments of follower 13 therefore occurs to provide rigidity that prevents follower 13 from buckling before completion of penetration.

Thus follower 13 functions substantially in the manner of the before mentioned rigid follower when suspended vertically by means of line 16 but permits recoverable bending without damage to occur while traversing stem roller 60.

An orientating link 96 (FIGS. 18, 29) having a cardioid cam 97 bearing a straight edge 98, as disclosed in the Applicant's UK Patent No. 2,199,005 and U.S. Pat. No. 4,864,955, is spaced from pig 68 in control segment 66. Chain 50 is connected via pin 99 to a rear clevis 100 on link 96 which clevis is inclined at 45° to edge 98. Link 96, in turn, is connected via shackle 101 to lowering and recovering line 16 which is paid out and heaved in by first winch 102 on deck 61 of anchor handling vessel 62 (FIG. 18). Link 96 can ride over roller 60 in a stable orientation only when straight edge 98 is in complete contact with roller 60 and always topples about cardioid cam 97 until this one stable orientation is established. Link 96 is therefore used to force the links of chain 50 to straddle at 45° against roller 60 in the one rotational orientation which, when communicated to control segment 66 via collar 70 and blocks 75 therein, brings yoke 87 into contact with roller 60 as control segment 66 is heaved up thereover.

Bottom terminal segment 51 of follower 13 is adapted for releasable connection to a drag anchor 23 as previously described and inlcudes an elongated clevis 103 (FIGS. 22–23) for straddling shank 2 of anchor 23 to enable a recessed socket 104 in each clevis leg to receive and mate with pivot pin 17 on shank 2. A lug 106 on each clevis leg 105 has a hole 107 drilled there through which registers with a hole 108 in shank 2 and receives a retaining shear pin 109 which holds anchor 23 temporarily in clevis 103 of bottom terminal segment 51 with forward direction F parallel to axis 20 and pin 17 mated in sockets 104. A stop 21 on a leg 105 of clevis 103 limits rotation of anchor 23 about pin 17 to a desired number of degrees by making contact with fluke 3. An anchor fore-runner line 4A, of length approximately five per cent longer than the length of pile 13, is attached at one end to shackle 5 of anchor 23 and at another end to a hinge link 110 for connection to anchor line 4. Hinge link 110 is fitted with a protruding hinge pin 110A. Two parallel hooks 111 are spaced apart and mounted on face 74 of control segment 66 remote from yoke 87. Each hook 111 serves as a support for engaging a protruding end of hinge pin 110A whereby hinge link 110 may be detachably attached to control segment 66 such that pulling upwards on anchor line 4 at an angle less than 60° off vertical disengages hinge link 110 from hooks 111. This detachable connection permits the azimuthal heading of anchor 23 to be controlled during installation by anchor line 4 pulling on hooks 111 without prematurely releasing shackle stop 35 and so preserving the facility of disengaging link 110 from hooks 111 subsequently by heaving up on anchor line 4.

Figure 27:
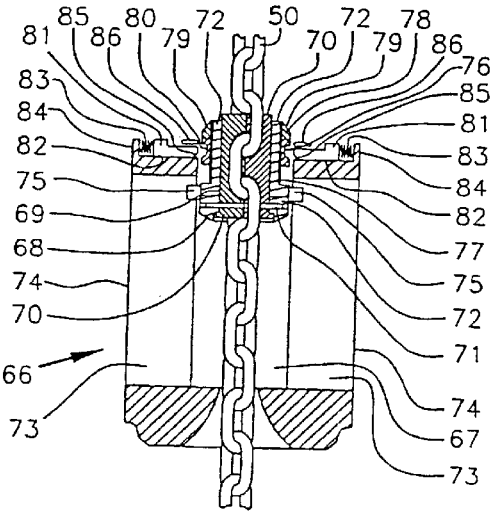
FIG. 27 shows a sectional side elevation of the control segment as shown in FIG. 25.
Figure 29:
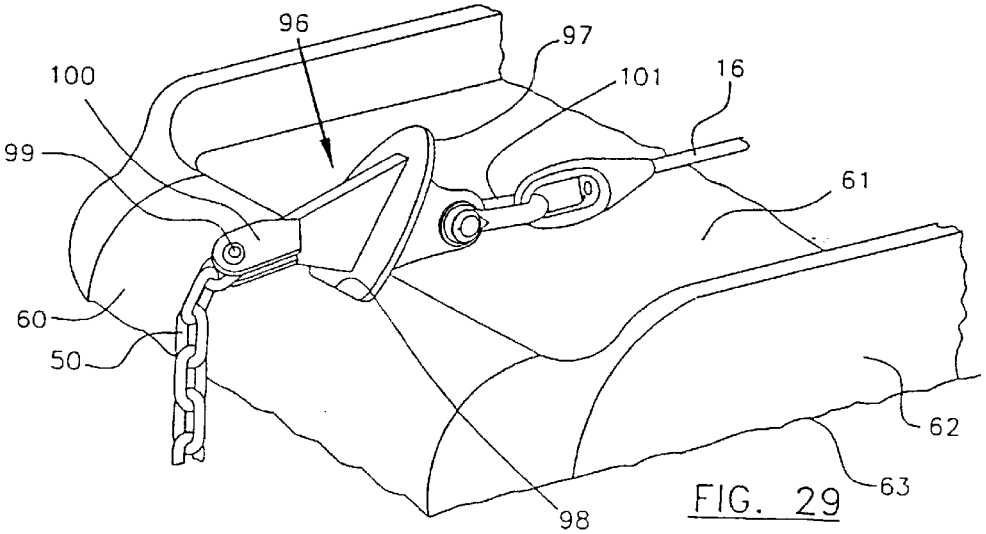
FIG. 29 shows an oblique view of an orientation link shown in FIG. 18 in an orientated attitude enforced by heaving in over a stern roller of an anchor handling vessel.
Figure 30:
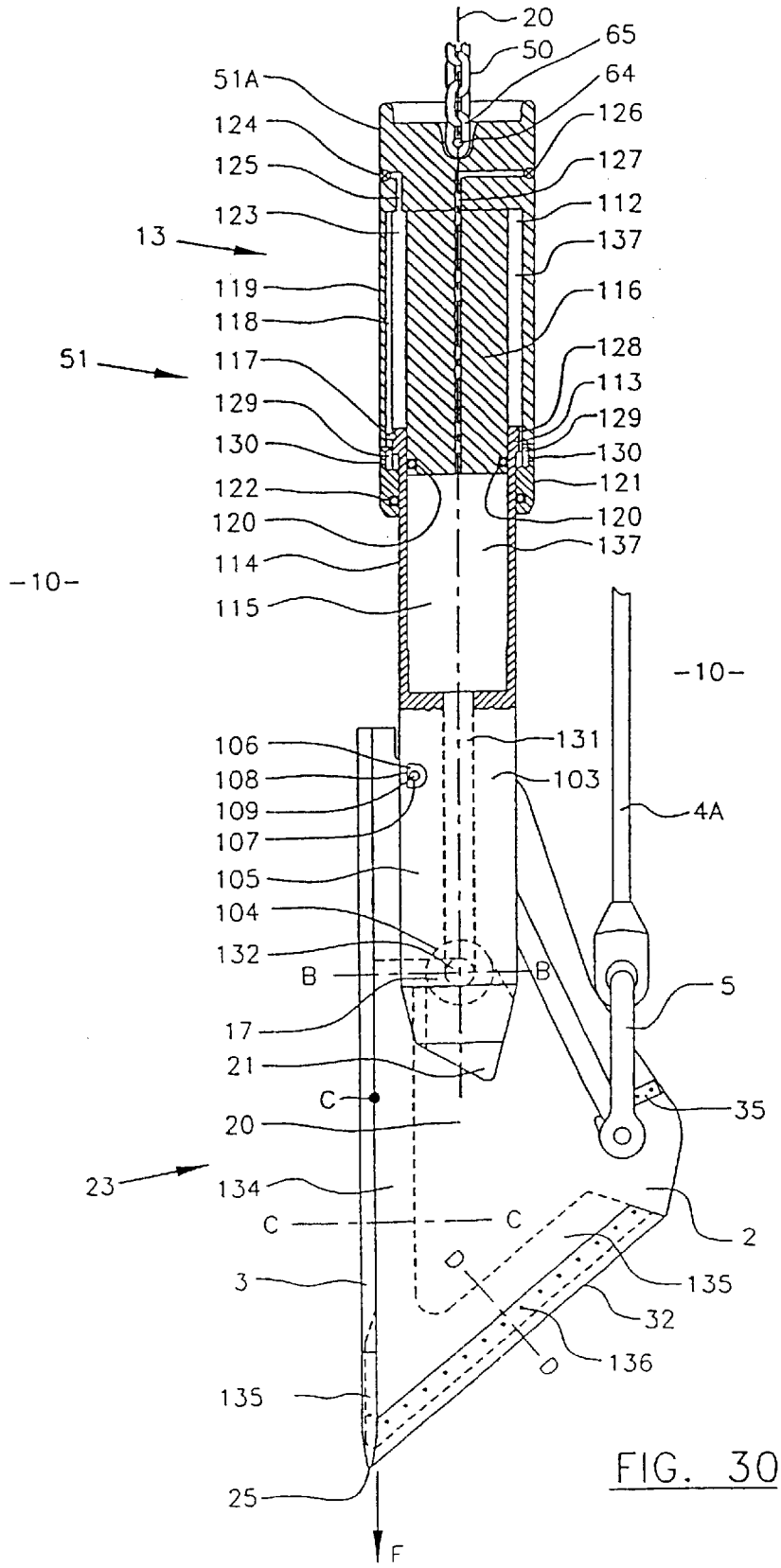
FIG. 30 shows to a larger scale a bottom terminal segment of the follower member and the anchor of FIG. 22.
Figure 31:
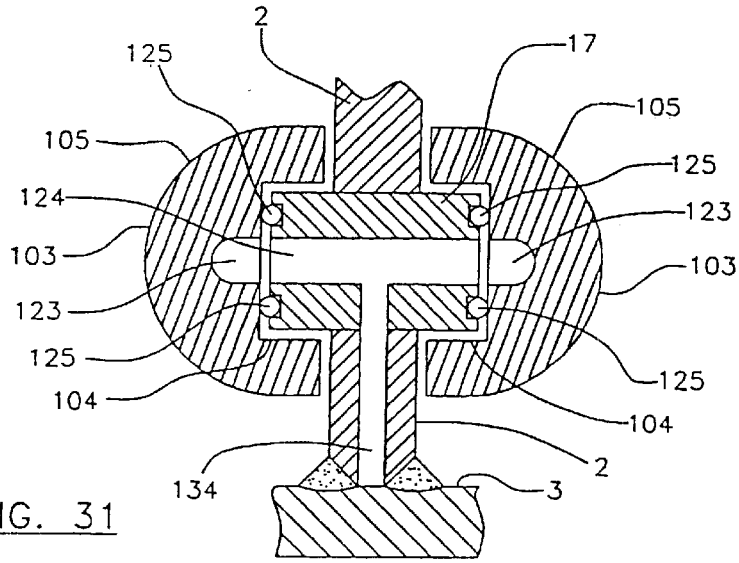
FIG. 31 shows a partial section B—B through a pivot connection between the bottom terminal segment of the follower member and the anchor of FIG. 25.
Figure 32:
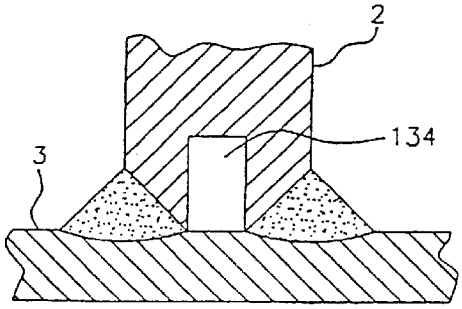
FIG. 32 shows a partial section C—C of a lubricant passage in the anchor of FIG. 25.
Figure 33:
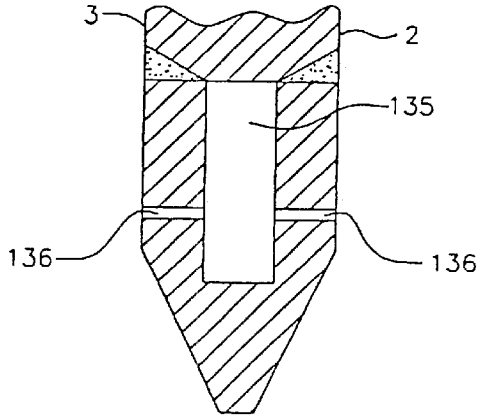
FIG. 33 shows a partial section D—D of a lubricant passage and discharge orifices present on forward edges of the shank and fluke of the anchor of FIG. 25.

For assembling in port, all components of follower 13 and drag anchor 23 are laid out on deck 61 of anchor handling vessel 62 (FIG. 18) with yoke 87 (FIGS. 25–26) on control segment 66 in contact with deck 61. Drag anchor 23 is fitted to bottom terminal segment 51 with pin 17 mated in sockets 104 and retaining shear pin 109 is fitted through aligned holes 107 and 108. Collar 70 (FIG. 27) is fixed to three links of chain 50 at the required distance from a bottom end of chain 50. Pig 68 is slid onto collar 70 and fixed thereto by pin 71. Chain 50 is then pulled through control segments 66 and segments 48 until pig 68 makes contact with the far end of borehole 67 (FIG. 27). Chain 50 now protrudes from a segment 48 remote from control segment 66 sufficiently to allow chain end link 65 to be secured in bottom terminal segment 51 by means of pin 64 (FIG. 30). A hydraulic chain jack is mounted on control segment 66 to pull on chain 50 and, consequently, compress together the segments of follower 13. The tensile force in chain 50 provided by the chain jack is set equal to the submerged buoyant weight of follower 13 and drag anchor 23 combined. This stretches chain 50 until groove 80 (FIG. 27) on sleeve 76 of pig 68 is pulled opposite latches 81 on control segment 66. Sleeve 76 is then rotated on thread 77 and locked thereon by ring 78 so that latches 81 are engageable in groove 80 just before the load in chain 50 equals the submerged buoyant weight of follower 13 and drag anchor 23 combined. The chain jack is then removed and orientation link 96 attached between line 16 and chain 50 at a separation from pig 68 sufficient to allow follower 13 to be rotatably clear of roller 60 when hanging there from with orientation link 96 in contact with roller 60 (FIG. 29). Anchor fore-runner line 4A is connected to shackle 5 on anchor 23 and to hinge link 110 which is then engaged in hooks 111 on control segment 62. This completes assembly on anchor handling vessel 62. Anchor line 4 is spooled on a winch on an assistant anchor line-carrying vessel prior to installation at sea.

At sea, anchor handling vessel 62 and the anchor line-carrying vessel proceed to the installation site. One end of anchor line 4 is passed over to vessel 62 for connection to hinge link 110 which is engaged on hooks 111 of control segment 66 of pile 13. Anchor line 4 is then allowed to hang slack in a bight between the vessels to provide directional control of pile 13 and anchor 23. On vessel 66, tugger winch lines are attached to control segment 66 via pulley blocks fixed adjacent stern roller 60 and operated to pull control segment 66 aft on deck 61 and so push drag anchor 23 and follower 13 overboard via stern roller 60. The weight of drag anchor 23 together with bottom terminal segment 51 projecting overboard causes follower 13 to bend through 90° over roller 60. The resulting induction of excess tension in chain 50 is prevented by pig 68 moving a distance W/4 axially along borehole 67 inside control segment 66. Follower 13 thus bends through 90° whilst traversing roller 60 with the tension in chain 50 rising only to a maximum value equal to the submerged buoyant weight of drag anchor 23 and follower 13 combined. When a sufficient weight of segments 48 are overboard, follower 13 becomes self-launching with braking restraint provided by winch 102 as it pays out line 16 ultimately to lower follower 13 and drag anchor 23 to the surface 8 of the mooring-bed 10 below. The anchor line-carrying vessel pays out anchor line 4 in step with line 16 being paid out by anchor handling vessel 62 and keeps sufficient tension in line 4 to control the azimuthal direction of follower 13 and anchor 23 until anchor 23 is buried in sea bed soil 10.

Tension induced in chain 50 due to the submerged weight of drag anchor 23 and follower 13 stretches chain 50 and permits groove 80 on pig 68 to engage with spring latches 81 which have been released by spring-driven movement of yoke 87 as control segment 66 clears roller 60. The latches 81 prevent chain 50 from containing and thus act to maintain the weight-induced tension in chain 50.

Drag anchor 23 is forced through mooring-bed surface 8 into soil 10 (FIG. 27) by the combined buoyant weight of anchor 23 and follower 13 as lines 16 and 4 are paid out. Line 16 may conveniently include a heave compensator comprising, for example, an elastic nylon portion to act as a stretchable absorber of heave motion of vessel 62 to facilitate smooth penetration of surface 8 by drag anchor 23. The segments of follower 13 are clamped together by the tension maintained in chain 50 by latches 81 so that follower 13 acts as if it were a rigid pile.

Completion of penetration of anchor 23 is signalled by a load cell on winch 102 on anchor handling vessel 62 and indicated by the tension in line 16 reducing to the submerged weight of line 16 when anchor 23 and follower 13 are completely supported by the sea bed soil. Line 16 is then paid out slack to allow vessel 62 to move clear of the position of follower 13. The anchor line-carrying vessel now moves to a position directly over follower 13 and heaves up on anchor line 4 so that hinge link 110 is disengaged from hooks 111 on follower 13 and line 4 becomes taut. A mark is made on taut line 4 which is then heaved in again until the mark has moved through a distance approximately equal to the length of two segments 48 of follower 13. This raises anchor 23 and follower 13 together in the sea bed soil 10 and simultaneously pivots anchor 23 about pin 17 in socket 104 (FIGS. 22–23) to cause shear pin 109 to part and force fluke 3 to tilt away from vertical. Anchor line 4 is next paid out to allow the submerged weight of follower 13 to drive anchor 23 downwards in the now tilted direction F of fluke 3 (FIG. 23). As line 4 is heaved upwards, a powerful couple is formed between the submerged weight of follower 13 and the tension in anchor line 4. As line 4 is subsequently paid out, a powerful couple is formed between the submerged weight of follower 13 and the now offset soil resistance force R acting on anchor 23. Both couples act to augment the desired rotation of anchor 23. This sequence is repeated several times. Each repetition rotates fluke 3 of anchor 23 further away from vertical until stop 21 makes contact with fluke 3 (FIG. 23). This rotation process, also known as keying, occurs without causing centroid C of fluke 3 to decrease in depth of penetration below sea bed surface 8 through a distance k as previously described for a direct embedment anchor 11 (FIG. 8) loaded after removal of the installing follower 13.

Anchor line 4 is now paid out slack to allow the anchor line-carrying vessel to move away to permit anchor-handling vessel 62 to reposition directly over follower 13 so that winch 102 can heave in line 16 to haul follower 13 off anchor 23, out of mooring bed 10, and up to stem roller 60. As control segment 66 contacts roller 60, yoke 87 is pushed against spring 89 and forces latches 81 against springs 83 and out of engagement with groove 80 in pig 68. Pig 68 is thus released to move a distance approximately equal to W/4 along borehole 67 to allow follower 13 to bend through 90° on moving up and over roller 60 without inducing undesirable extra tension in chain 50. Hauling by winch 102 is stopped when all of follower 13 is on deck 61.

Vessel 62 then steams ahead to pull the anchor line 4 into soil 10 (FIG. 24) at an appropriate angle to horizontal for the mooring of an object to be restrained on the sea surface. The resulting movement of shackle 5 causes peg 46 (FIGS. 14–16) on shackle eye 47 to push plates 37 of stop 35 into the released position on shank 2 of anchor 23 ready for easy later retrieval of anchor 23. Pulling anchor line 4 away from the direction of the restrained object then causes shackle 5 to slide in slot 29 to extremity 30 (FIG. 11) whereby low resistance to recovery of anchor 23 may be realised during retrieval.

As for the directly embedded drag embedment anchor 1 previously described, directly embedded drag anchor 23 will follow a downwardly inclined curved trajectory 9 if loaded beyond the capacity it can provide at the target embedment depth. Anchor 23 will thus increase capacity to match the overload. Ultimately, as for traditional drag embedment anchors, drag anchor 23 will reach a limiting depth below surface 8 of mooring bed 10 at which maximum capacity will be reached but catastrophic failure will not occur since anchor movement is now horizontal and, in consequence, a normal safety factor of 1.5 for drag embedment anchors may be utilised.

Anchor 23 and follower 13 may advantageously be adapted to incorporate the teachings of the present applicant's co-pending International Patent Application No. PCT/GB98/01089 (publication no WO98/49048) that discloses apparatus for providing a film of lubricant on external surfaces of a marine anchor and a direct embedment follower. With reference to FIGS. 30–33, control segment 51 of follower 13 is attached to chain 50 as previously described. Upper portion 51A of segment 51 includes an axial cylindrical cavity 112 and an annular piston 113 attached to piston rod 114. Annular piston 113 and piston rod 114 contain an elongate cylindrical cavity 115 which accommodates an elongate fixed piston 116. A top end of piston 116 is rigidly attached to upper portion 51A of segment 51 inside cavity 112. Annular piston 113 is rotationally locked to upper portion 51A by key 117 slidable in an internal groove 118 inside cavity wall 119 of upper portion 51A. A piston ring seal 120 is fitted at a bottom end of fixed piston 116. A detachable retaining cap 121 forms part of segment 51 and serves inter alia to retain piston 113 inside cavity 112 and house ring seal 122 for sealing piston rod 114. Thus, segment 51 contains an upper annular cavity 123 surrounding piston 116 and a lower cylindrical cavity 115 inside piston rod 114. In segment 51, non-return valve 124 and passageway 125 permit cavity 123 to be filled with a suitable lubricant and non-return valve 126 and passageway 127 through fixed piston 116 permits cavity 115 to be filled with the lubricant, whereupon piston rod 114 is maximally extended from retaining cap 121.

Piston 113 has peripheral passages 128 parallel to axis 20 serving to conduct lubricant past piston 113 into circumferential passageway 129 in retaining cap 121. A plurality of holes 130 communicating with passageway 129 are equally spaced along the circumference of retaining cap 121 to act as external outlet orifices to deliver lubricant evenly to the external surface of retaining cap 121. Piston rod 114 includes clevis 103, which has clevis legs 105 (FIG. 30). A passage 131 leads from cavity 115 inside piston rod 114 and along each leg 105 to sockets 104 of clevis 103 such as to register with and join into passage 132 axially located in pin 17 of anchor 23 when pin 17 is mated in sockets 104 of clevis 103 (FIG. 30). Ring seals 133 (FIG. 31) provide slidably disengagable rotary sealing between pin 17 and clevis 103 inside sockets 104. Passage 134 (FIGS. 30–32) runs inside shank 2 of anchor 23 from passage 132 in pin 17 to passages 135 (FIGS. 30, 33) which run parallel with and enter into sharpened edge 32 of shank 2 and sharpened edge 25 of fluke 3. Holes 136 are spaced equally along edges 25 and 32 to provide external outlet orifices for passages 135 (FIGS. 30, 33) to deliver lubricant evenly to the external surfaces of shank 2 and fluke 3 of anchor 23.

In use, cavities 115 and 123 are filled with biodegradable vegetable grease lubricant 137 via non-return valves 126 and 124 respectively. When anchor 23 penetrates surface 8 of mooring bed 10 as previously described, soil resistance force R (FIG. 22) forces pistons 113 and 116 (FIG. 30) to pressurise lubricant 137 in cavities 115 and 123 and force lubricant along passages 128, 131, 132, 134, and 135 and out of holes 130 and 136 as anchor 23 and follower 13 are forced into the mooring bed soil 10 by their combined submerged weight. The isolation of cavity 115 from cavity 123 ensures that a desired apportionment of volume of lubricant discharged from follower 13 relative to that discharged from anchor 23 for unit movement of piston rod 114 may be achieved. The discharged lubricant 137 is entrained with soil 10 passing over the external surfaces of anchor 23 and follower 13 and thus greatly reduces the ability of soil to adhere to these surfaces. The effective skin friction forces on the external surfaces of anchor 23 and follower 13, due to soil adhesion, are therefore very considerably reduced with concomitant desirable promotion of penetration into mooring bed 10 and, very significantly, subsequent promotion of low retrieval loads when recovering follower 13 from mooring bed 10. When follower 13 is disengaged from anchor 23, the supply of lubricant is cut off. Subsequent movement of anchor 23 along trajectory 9 wipes off any residual lubricant thus restoring the frictional restraints on anchor 23 allowing functioning as a drag anchor as previously described.

Figure 34:
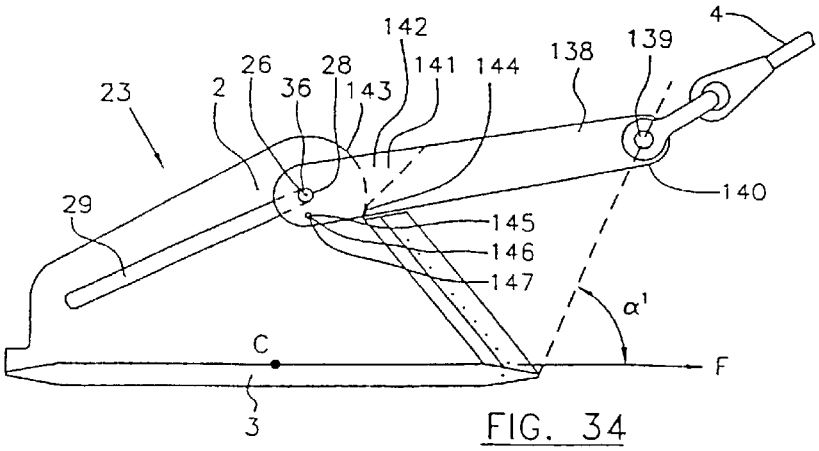
FIG. 34 shows the anchor of FIG. 11 modified to act initially in the manner of the anchor of FIG. 1 and subsequently in the manner of the anchor of FIG. 11.

Anchor 23, further, may be adapted to have an elongate plate member 138 (FIG. 34), instead of a shackle attached to shank 2, with an anchor line attachment hole 139 at an end 140 and a clevis 141 at another end 142 that straddles shank 2 and carries pin 36 for slidable and rotatable engagement in straight slot 29. Shank 2 has an arcuate surface 143 centred on attachment point 26 at a forward extremity 28 of slot 29. A stop 144 inside clevis 141 makes sliding contact with surface 143 whereby pin 36 is held at point 26 until rotation of member 138 about point 26 brings the direction of movement of stop 144 parallel to slot 29 whereupon pin 36 is free to slide in slot 29. A rotation-stopping shear pin 145 is mounted in holes 146 in clevis 141 and in registering hole 147 in shank 2 and serves to hold elongate plate member 138 at a desired position where angle $\alpha'$ is less than 95° and preferably less than 75°. Shear pin 145 is of a size such as to part when a particular value of loading at hole 139 from anchor line 4 is exceeded. This allows anchor 23 to act initially as a drag embedment anchor prior to parting of shear pin 145, and then to act as a drag anchor of greatly increased holding capacity when dragged further.

A drag anchor 23 (FIGS. 22–24), weighing 9 kg., and a follower 13, weighing 126 kg., were subjected to tests in a slightly over-consolidated soft clay sea bed 10. All mechanisms and procedures previously described functioned as planned. With centroid C (FIG. 24) of anchor 23 installed by follower 13 to a depth below sea bed surface 8 of three times the square root of the area of fluke 3, anchor 23 provided a holding capacity of 53 times anchor weight (immediately after recovery of follower 13 from sea bed 10) when anchor line 4 was pulled at an inclination of 18° to horizontal at sea bed surface 8. Further pulling caused anchor 23 to drag whilst burying deeper to give a progressively increasing holding capacity that ultimately became constant at 189 times anchor weight with centroid C moving horizontally and with anchor line 4 inclined at 23° to horizontal. Tests with and without lubricant 137 (FIG. 30) showed that the lubricant increased penetration of centroid C of fluke 3 by 3.2 times and indicated that follower 13 required to be almost three times heavier without lubrication to achieve the same penetration as occurred with lubrication. In an unlubricated test where centroid C on fluke 3 of anchor 23 was installed by follower 13 to a depth below sea bed surface 8 of 1.1 times the square root of the area of fluke 3, anchor 23 gave a progressively decreasing holding capacity and rose back up to sea bed surface 8 on being dragged from its installed position. These tests proved the effectiveness of lubricated installation by follower of drag anchor 23 and of eschewing the before-mentioned Danforth limits for angles $\alpha$ and $\beta$ (FIG. 11) of anchor 23.

The disclosures herein provide particular embodiments of the present invention and the tests outlined above show that the objectives of the invention have been met. It will be apparent that variations in these embodiments are within the scope of the invention. For example, a highly stretchable synthetic rope may be used inside follower 13 instead of chain 50 with the result that the tension relieving mechanism of control segment 66 may not be required.

What is claimed is:

1. Anchoring apparatus comprising a marine anchor including a fluke member (3) and load application point (26) and anchor embedment means (13), said anchor comprising one of a drag embedment anchor (1) a direct embedment anchor (11) or a drag anchor (23) while the embedment means comprises an elongate follower member (13) releasably attached to the anchor and adapted for pushing said anchor into a mooring bed (10) substantially in a forward direction F in which the surface of fluke member (3) viewable from the load application point (26) when the anchor is in operation has a minimum projected area, characterised in that at least one of said anchor and said elongate follower member (13) is adapted to provide a reaction fulcrum (17) about which the anchor may pivot.

2. Anchoring apparatus as claimed in claim 1, characterised in that a material layer of low friction substance is provided on at least one of the anchor embedment means (13) and the anchor.

3. Anchoring apparatus as claimed in claim 1, characterised in that said marine anchor is adapted for pivoting about said fulcrum (17) when a pulling force is applied to the anchor by an attached anchor line (4).

4. Anchoring apparatus in the form of a marine anchor including a fluke member (3) and a load application point (26) on the marine anchor for attaching an anchor-line attachment-means (5), said marine anchor in operational configuration being an anchor for operation below the surface of a mooring bed (10) characterised in that a straight line containing said load application point (26) and the centroid (C) of the fluke member surface viewable from said load application point when the anchor is in operation forms a forward-opening centroid angle $\beta$ with a forward direction F, in which direction said fluke member surface has a minimum projected area, said angle $\beta$ being in the range 68° to 85° for operation of the anchor in soft cohesive soil and being in the range 50° to 65° for operation in non-cohesive soil whereby a pulling force applied to the anchor by the anchor line at the anchor-line attachment-means load application point (26), when the anchor fluke centroid (c) is buried at least twice the square root of said maximum projected area below the mooring bed surface causes the anchor (1, 23) to tend to move in the soil of the mooring bed (10) with a substantial component (9B) of displacement in said forward direction F.

5. Anchoring apparatus according to claim 4, characterised in that said component (9B) of displacement exceeds 35 per cent of the actual displacement (9A).

6. Anchoring apparatus as claimed in claim 4, characterised in that said centroid angle ($\beta$) does not exceed 80° for operation in soft cohesive soil and does not exceed 60° for operation in non-cohesive soil.

7. Anchoring apparatus as claimed in claim 6, characterised in that said drag anchor (23) is further characterised in that a plane orthogonal to the plane of symmetry (X—X) of the anchor and containing a forward extremity of the fluke member (3) and said load application point (26) forms a forward-opening point angle ($\alpha$) with said forward direction F which is not less than 95° for operation in soft cohesive soil and not less than 85° for operation in non-cohesive soil.

8. Anchoring apparatus as claimed in claim 4, characterised in that the drag anchor (23) comprises a fluke member (3) with a plate-like shank member (2) rigidly attached thereto and lying parallel to said plane of symmetry (x—x).

9. Anchoring apparatus as claimed in claim 8, characterised in that said plate-like shank member (2) includes an elongated slot (29) for slidable movement therein of the anchor line attachment means (5) with a forward end (28) of said slot (29) serving as a first anchor-line attachment-means load application point permitting deeper burial of the anchor (23) by dragging and with a rear end (30) located towards a rear edge of said fluke member (3) serving as a second anchor-line attachment-means load application point facilitating rearwards recovery of the anchor (23) in a direction substantially opposite to said forward direction (F).

10. Anchoring apparatus as claimed in claim 9, characterised in that in the shank member (2) a slide stop means (35) is provided just aft of the forward end (28) of said slot (29) to restrain said attachment means (5) at said first load application point (26).

11. Anchoring apparatus as claimed in claim 10, characterised in that the slide stop means (35) includes release means (44, 46) which cooperate with said anchor line attachment means (5) whereby rotational displacement of said attached means (5) releases said slide stop means (35) to permit said attachment means (5) to slide in said slot towards the rear edge (31) of said fluke member (3).

12. Anchoring apparatus as claimed in claim 11, characterised in that said anchor-line attachment-means comprises an elongate member (138, FIG. 34) with an attachment point (139) at one end (140) serving for connection to an anchor line (4) and with a clevis (141) at the other end carrying a pin member (36) serving to engage slidably and rotatably in said slot (29) of said shank member (2).

13. Anchoring apparatus as claimed in claim 12, characterised in that said shank member (2) includes an arcuate surface (143) centred on said first load application point (26) and said elongate member (138) includes a stop (144) slidably engageable on the arcuate surface (143) whereby said pin member (36) is held at the first load application point (26) in said slot (29) until rotation of the elongate member (138) about the load application point (28) brings the direction of movement of the stop (144) parallel to the slot (29) whereupon the pin member (36) is free to slide in the slot (29) in the shank member (2).

14. Anchoring apparatus as claimed in claim 13, characterised in that said anchor (23) includes releasable rotation stop-means (145) which stops rotation of said elongate member (138) at a predetermined position relative to said shank member (2) when said pin member (36) is at said first load application point (26).

15. Anchoring apparatus as claimed in claim 14, characterised in that the length of said elongate member (138) is such that, when the elongate member (138) is stopped from rotating by said releasable rotation stop-means (145), a plane lying orthogonal to said plane of symmetry (x—x) and containing a forward extremity of said fluke member (3), and said attachment point on the elongate member (138) forms a forward-opening angle ($\alpha'$) with said forward direction F which is less than 95°.

16. Anchoring apparatus as claimed in claim 15, characterised in that said forward-opening angle ($\alpha'$) is less than 75°.

17. Anchoring apparatus in the form of embedment means (13) for directly embedding a marine anchor, said embedment means (13) comprising an elongate follower member including means for driving the anchor into a mooring bed, means for detachable attachment to the marine anchor, and means for bending recoverably when subjected to transverse forces.

18. Anchoring apparatus as claimed in claim 17, characterised in that said follower member (13) includes a lower terminal segment (51) attached to a lowering and recovering line (50) and includes a plurality of body segments (48) supported by said lower terminal segment (51).

19. Anchoring apparatus as claimed in claim 18, characterised in that said body segments (48) substantially encircle said lowering and recovering line (50).

20. Anchoring apparatus in the form of embedment means (13) for directly embedding a marine anchor, said embedment means (13) comprising an elongate follower member adapted for detachable attachment to the marine anchor, characterised in that:

said follower member (13) is adapted to bend recoverably when subjected to transverse forces;

said follower member (13) includes a lower terminal segment (51) attached to a lowering and recovering line (50) and includes a plurality of body segments (48) supported by said lower terminal segment (51);

said body segments (48) substantially encircle said lowering and recovering line (50); and said segments (48) fit together by means of a convex protuberance (52) on one segment (48) registering with a corresponding concave recess (55) on the adjacent segment (48).

21. Anchoring apparatus as claimed in claim 20, characterised in that when said line (50) within said body segments (48) is extended under tension when said follower member (13) is hanging vertically, said line (50) is prevented from relaxing by a line stop means (81) acting between an upper body segment (66) and said line (50) whereby said body segments (48) are maintained in a state of axial compression which provides said elongate follower member (13) with a degree of transverse stiffness to resist buckling when said follower member (13) is at least partly supported by contact with a sea bed surface.

22. Anchoring apparatus as claimed in claim 21, characterised in that said line stop means (81) is releasable whereby, when said follower member (13) is pulled up and bent over a curved surface, said line (50) is released within the follower member (13) to allow relative axial movement between the line (50) and the upper body segment (66) to avoid excessive stretching of the line (50) due to bending of the follower member (13).

23. Anchoring apparatus as claimed in claim 22, characterised in that said line stop means (81) is releasable by means of movement of an actuator (87) making contact with said curved surface.

24. Anchoring apparatus as claimed in claim 23, characterised in that said line stop means (81) includes a tooth member located on one of said line (50) and said upper body segment (66) which engages in a recess (80) in a recess member (76) located on the other one of the line and the upper body segment (66).

25. Anchoring apparatus in the form of embedment means (13) for directly embedding a marine anchor, said embedment means (13) comprising an elongate follower member adapted for detachable attachment to the marine anchor, characterised in that said follower member (13) is adapted to bend recoverably when subjected to transverse forces, said anchoring apparatus further including an anchor embedment means in the form of an elongate follower (13) having a bottom end adapted for the releasable attachment thereto of a marine anchor (1, 11, 23), said follower (13) serving to push the anchor (1, 11, 23) through a mooring bed (10) to a buried position in the bed, characterised in that the follower (13) includes means for supplying lubricating fluid for the provision of a layer of low friction substance on the anchoring apparatus, said lubricant supply means comprising piston-cylinder means (112, 113, 114) for providing reservoir means (115, 123) for providing lubricant, and delivery ducting (122, 131, 132, 134, 135) for the delivery of lubricant from the reservoir means (115, 123) for the provision of said low friction layer, lubricant delivery being achieved by relative movement between the piston and cylinder.

26. Anchoring apparatus as claimed in claim 25, characterised in that said reservoir means comprises separate reservoir parts (115, 123) for individual supply of lubricant for the follower (13) and for the attached anchor (23) respectively.

27. A method of deploying a drag embedment anchor (1) or direct embedment anchor (11) or drag anchor (23), comprising detachably attaching an elongate follower member (13) pivotably to the anchor (1, 11, 23) via a pivot (17) and pushing said anchor into a mooring bed (10) by the follower member(13) substantially in a direction of minimum projected area of the surface of a fluke member (3) of the anchor as viewed from a load application point (26) of an anchor line attachment means (5) attached to an anchor line (4) until a centroid (C) of the anchor fluke member (3) is at least twice the square root of the maximum projected area of the fluke member (3) below the surface of the mooring bed (10), and pulling on said anchor line (4) before detachment of the follower member (13) from the embedded anchor (1, 11, 23) so as to cause the fluke member (3) to rotate to an operational attitude in the soil of the mooring bed (10) by pivotal reaction with the follower (13).

* * * * *